US005951966A

United States Patent [19]

Wang

[11] Patent Number: 5,951,966

[45] Date of Patent: Sep. 14, 1999

[54] COMPOUND TOOTHPASTE AND A METHOD OF MAKING IT

[76] Inventor: Haisheng Wang, Room 202, W. 4th Road, Renmin Street, Xiashan District, Zhanjiang 524000, Guangdong, China

[21] Appl. No.: 08/776,463

[22] PCT Filed: Jul. 10, 1995

[86] PCT No.: PCT/CN95/00059

§ 371 Date: Mar. 7, 1997

§ 102(e) Date: Mar. 7, 1997

[87] PCT Pub. No.: WO96/01767

PCT Pub. Date: Jan. 25, 1996

[30] Foreign Application Priority Data

Jul. 10, 1994 [CN] China ..... 94108318

[51] Int. Cl.[6] ..... A61K 7/16; B65D 35/00

[52] U.S. Cl. ..... 424/49; 222/92

[58] Field of Search ..... 222/92; 424/49

[56] References Cited

U.S. PATENT DOCUMENTS

| | | | |
|---|---|---|---|
| 2,636,644 | 4/1953 | Taylor | 222/92 |
| 4,687,663 | 8/1987 | Schaeffer | 424/52 |
| 4,964,539 | 10/1990 | Mueller | 222/94 |
| 5,169,030 | 12/1992 | Lewin | 222/92 |

FOREIGN PATENT DOCUMENTS

| | | |
|---|---|---|
| 2057659 | 11/1989 | China . |
| 0243321 | 10/1987 | European Pat. Off. . |

*Primary Examiner*—D. Margaret M. Mach

*Attorney, Agent, or Firm*—Sughrue, Mion, Zinn, Macpeak & Seas, PLLC

[57] ABSTRACT

This invention relates to a compound toothpaste which includes a housing part and a paste part The paste part is composed of several pastes which are separated by biomacromolecule colloid diaphragm. The housing part may include lubricant membrane covered on inside wall and a cutter which is arranged on exit and towards the paste parts. Because the toothpaste contains several pastes, function can be raised. Since a biomacromolecule colloid diaphragm is adopted, packing system which has simple structure is provided which eliminates remainder from the housing.

19 Claims, 1 Drawing Sheet

COMPOUND TOOTHPASTE AND A METHOD OF MAKING IT

This application is a 371 of CN95/00059, filed Jul. 10, 1995.

FIELD OF THE INVENTION

This invention relates to a toothpaste, and more particularly relates to a compound toothpaste.

BACKGROUND ART

Generally, a conventional toothpaste packs only one kind of paste. Certain kind of paste usually effect certain kind of health-cares. However, in the microbe pool of a person's oral cavity, pathogenic microbes which are harmful to human body and non-pathogenic microbes which are harmless are interdependent and interactive, and jointly maintain the ecological balance of microbes in the oral cavity. If a tooth paste with unitary function is used for a long time, both pathogenic and non-pathogenic microbes are restrained and sterilized, so the ecological balance of microbes in the oral cavity is damaged, which can cause intrusion of new pathogenic microbes and therefore stomata disease, and increase the difficulty of treatment Furthermore, long-term use of the same toothpaste (including those with similar chemical ingredients) may cause drug-fastness of pathogenic microbes in the oral cavity and imbalance of bacteria and make it difficult to obtain the object of disease prevention and treatment. Long-term use of some medicated toothpaste may even cause by-effects of kidney and liver damage, that is mainly because the oral cavity and teeth may effect some absorption. Clinical experiments indicate that a certain medicated toothpaste should not be used continuously for more than 2–3 months and the optimal treatment effect of each medicated toothpaste is obtained within 5–7 days of use. Therefore, various kind of medicated toothpaste should be used alternatively to obtain the optimal treatment effect.

Thus, the inventor of this invention provided a compound tooth paste in a Utility Model Patent CN 92226134.2. In the Utility Model, several kinds of pastes are packed separately in plastic bags to prevent them from mixing, Soft foils are used as diaphragm to separate the pastes packed in the plastic bags in order to obtain the object of alternative use of the pastes. The Utility Model solved the problem of long-term use of a unitary toothpaste, however, some new problems occur, for example, the plastic bags remain in the housing especially when there are a great number of paste layers. The remainder increases during the period of use, and the remainder of the plastic bag will cause remainder of the paste and thus may cause mixing of different pastes and deteriorating its performance. On the other hand, the plastic scraps which are cut off from the plastic bags are squeezed out together with the paste and become waste in the paste. Furthermore, due to the distortion of the plastic bags and poor flexibility of the diaphragm of soft foils, the plastic bags are subject to displacement so that the different pastes could not be used alternatively. Moreover, due to the introduction of the plastic bags and diaphragm soft foils, the manufacturing process becomes much more complicated, and the product cost is thus increased.

OBJECTS OF THE INVENTION

With above consideration, the object of this invention is to provide a toothpaste with several kinds of pastes packed in it, so as to avoid the by-effect to the user caused by long term use of a unitary paste, to effect much better health-care of the toothpaste such as cleaning teeth, removing dental calculus, treating and preventing diseases, to remedy the above-mentioned disadvantages, and to decrease the product cost.

Another object of this invention is to provide a method of making a compound toothpaste.

SUMMARY OF THE INVENTION

To obtain the above objects, in the first aspect of the invention, a compound toothpaste is provided, which comprises of a paste part and a housing part. The paste part includes at least two layers of different pastes. Between the adjacent layers of each paste there exists a biomacromolecule colloid diaphragm. The housing part has an outlet end. The paste part is packed in the housing part, in order to be squeezed out alternatively through the outlet end when the toothpaste is used.

In the second aspect of the present invention, a method of making a compound toothpaste is provided, which comprises of the following steps: preparing a housing part; and packing a paste part into the housing part.

The step of pacing the paste part includes: filing a first layer of paste into the housing part, forming a biomacromolecule colloid diaphragm on the first layer of paste; filling a second layer of paste into the housing part above the biomacromolecule colloid diaphragm, so as to separate the first layer of paste and the second layer of paste with the biomacromolecule colloid diaphragm.

In this way, the steps of forming the biomacromolecule colloid diaphragm and filling another kind of paste can be repeatedly performed till the last kind of paste is filled.

The method may also comprise of a step of forming a lubricant film on the inner side of the housing part before the step of packing the paste part into the housing part.

DETAILED DESCRIPTION OF THE EMBODIMENTS

Figure 1:
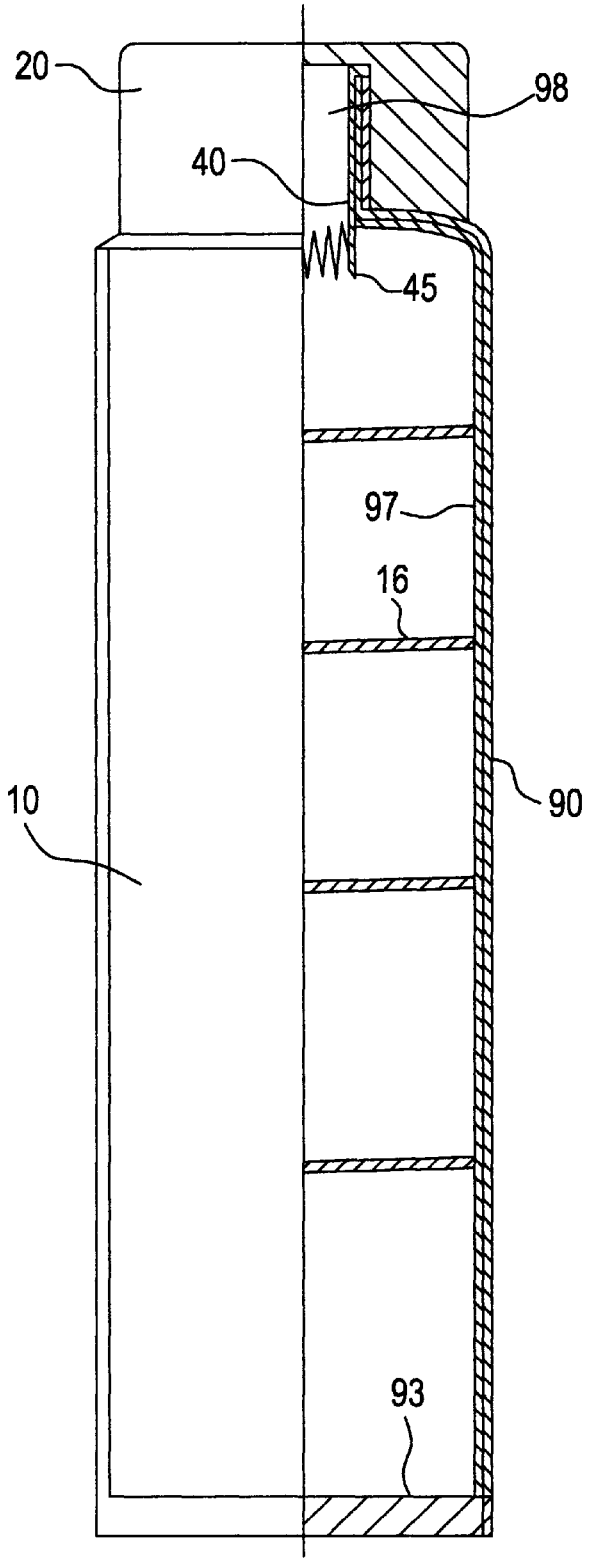
FIG. 1 is the schematic diagram of a compound tooth paste according to the present invention.

Referring to FIG. 1, a toothpaste of this invention comprises of a paste part 10 and a housing part 90. The paste part 10 includes at least two layers of paste. The paste in each layer is at least different from the paste in the adjacent layer(s). For example, in FIG. 1, there are five layers of different pastes, in which each layer of paste is separated by biomacromolecule colloid diaphragm 16 to form the paste part integrally while each layer of paste is not mixed with other layer(s). The biomacromolecule colloid diaphragm 16 is directly coated on the respective layer of paste. The housing part 90 with an outlet end 98 has a main body of substantially cylindrical shape. The reference number 93 in FIG. 1 indicate the sealed end of the housing part. Said paste is paste material for cleaning teeth.

The housing part 90 can be made from materials which are deformable when squeezed, such as soft metal or non-poisonous plastics. A housing part of a toothpaste which is conventionally applied to pack unitary paste can be used as the housing part of this invention.

The biomacromolecule colloid which is used to form the biomacromolecule colloid diaphragm is conventional biomacromolecule colloid harmless to human body, such as agar, fruit gel etc. The diaphragm formed with biomacromolecule colloid has good flexibility and elasticity and can be adhered to the paste integrally to prevent the pastes from mixing. Even when the user squeezes any part of the housing part 90 and deforms it, the biomacromolecule colloid diaphragm 16 can move together with the paste and keep the layers of pastes separate from each other. Since the diaphragm 16 is harmless to human body, it does not matter even when it is brought into the oral cavity together with the paste. While using the toothpaste, the diaphragm 16 can squeezed out together with the paste, thus the remainder in the toothpaste is largely decreased.

As shown in FIG. 1, each kind of paste is filled in the housing part 90 in different layer, therefore each layer of paste is alternatively squeezed out of the outlet end in a definite sequence while using the toothpaste. The kind of the paste changes after a certain time of use, the volume of each layer of paste can be identical or different from each other as required The inside wall of the housing part 90 can also be coated with a lubricant film 97, that can be formed by spraying lubricant material which is harmless to human body, such as biotic small molecule gel, to decrease the resistance to the paste movement in the housing and to decrease the remainder in the toothpaste.

A cutter 40 with an edge 45 projecting to the paste can also be provided on the housing part 90 near to the outlet end 98. The cutter 40 can be assembled on the outlet end 98 in such a way as to be elastically clamped by a projection and a groove, integrally formed on the housing part 90, or arranged on the inner side of the outlet end ill other conventional ways that are known to those skilled in the art. The cutter can easily break the biomacromolecule colloid diaphragm 16, so that the user can use the paste covered by the diaphragm 16, to realize the object of changing paste.

In accordance with the invention, a paste part for use in a toothpaste includes at least two layers of pastes separated by a biomacromolecule colloid diaphragm, wherein the paste ingredients in the adjacent layer are different. Preferably the paste in each layer is of different ingredients to the other layers of the pastes. The biomacromolecule colloid diaphragms between the layers of the paste are directly adhered to the respective layer of paste and separate the layers of the pastes from each other.

A compound toothpaste in an embodiment of this invention comprises of a paste part 10, a housing part 90 with an outlet end 98, and an outlet cover 20 that removably covers the outlet end. The paste pat 10 includes at least two layers of paste, for example, five layers, in which the paste in each layer is different from that in the other layers. Between layers of different paste, there is a biomacromolecule colloid diaphragm 16 that separates the layers of paste from each other to prevent them from mixing. The paste part 10 is packed in the housing part 90. The arrangement of layers of paste in the housing part makes it possible for the paste in each layer to be squeezed out through the outlet end 98 in a definite sequence while using the toothpaste. On the inside wall of the housing part 90, a lubricant film 97 is formed for example, by spraying. The lubricant film 97 decreases the resistance to the paste movement in the housing and decreases the remainder of paste. A cutter 40 with an edge 45 projecting to the paste is also provided on the housing part 90 near to the outlet end 98. The cutter can be in the form of a hard plastic tube with dentate edge and be formed by a tube-making machine, the cutter can break the biomacromolecule colloid diaphragm between layers of paste, to obtain the object of changing the pastes with different medical effects.

While using the toothpaste, all layers of paste are moved by the squeezing force along the inside wall of the housing which is coated with the lubricant film 97 such as a biotic small molecule gel to the outlet 98. When the first kind of paste is run out, the diaphragm 16 on the second kind of paste is sequentially broken by the cutter 40. The second kind of paste can is be squeezed out of the outlet 98. These procedures repeat during use until the last kind of paste is completely run out.

It could be understood to those skilled in the art that various modifications can be made to the toothpaste or other features can be added to the toothpaste, for example, the outlet cover and the outlet end of the housing part can be coupled in the way of clamping or thread, the connection part of the outlet end and the main body of the housing can be formed in a structure which makes it easier to squeeze the paste out, the kind and the volume of the said pastes can be determined to effect the optional functions of the tooth paste, and the pastes can be of medicated paste or of other kinds, etc.

A method of making a compound tooth paste of this invention includes the following steps: providing a housing part 90; packing a paste part into the housing part. The step of packing the paste part includes the following steps: filling a first layer of paste into the housing part 90; forming a biomacromolecule colloid diaphragm 16 on the first layer of paste; and filling a second layer of paste into the housing part above the biomacromolecule colloid diaphragm 16, therefore the first layer of paste and the second layer of paste are separated by the biomacromolecule colloid diaphragm, meanwhile the arrangement of layers of paste in the housing part makes it possible for the paste in each layer to be squeezed out of the housing in a definite sequence while using the toothpaste.

The biomacromolecule colloid diaphragm over the paste can be formed in conventional ways, such as spraying method, etc. In an embodiment of this invention, the biomacromolecule colloid is agar. In this connection, the temperature range of spraying is 60–90° C. In another embodiment of this invention, the biomacromolecule colloid in use is fruit gel, while the temperature range of spraying is from 20° C. to boiling point of the fruit gel.

In accordance with this invention, it is obvious to those skilled in the art that the steps of filling the paste and the step of forming the biomacromolecule colloid diaphragm can be repeated to pack the desired number of layers of the pastes.

The above-mentioned method may also include a step of forming a lubricant film 97 on the inside wall of the housing before the step of packing the paste part, in such a way as spraying biotic small molecule gel in order to decrease the resistance to the paste movement in the housing.

In summary, because several kinds of paste are separated from each other by the biomacromolecule colloid diaphragms and integrally packed into the same housing of a toothpaste, each kind of paste in the toothpaste can effect its optional functions. Furthermore, this tooth paste solves the problem of large quantity of remainder in the housing in the prior art. Due to the simple structure, this kind of toothpaste can be manufactured on the present production lines with slight modifications, therefore the production cost is largely decreased.

The above embodiments are for the purpose of explanation and description of the invention, and it is not intended to limit the invention. The invention is subject to the limitation of the appended claim. Various modifications should be possible within the scope and spirits of the invention without departing from the appended claims.

I claim:

1. A compound toothpaste, comprising a paste part (10) and a housing part (90) with an outlet end (98), characterized in that the paste part (10) includes at least two layers of paste, in which the paste in each layer is different from the paste in each adjacent layer, a biomacromolecule colloid diaphragm located between the layers of the pastes to separate the layers of pastes from each other, wherein the paste part (10) is packed into the housing part (90) so that the arrangement of the layers of the pastes makes it possible for the paste in each layer to be squeezed out in a definite sequence while using the toothpaste; a cutter (40) arranged in the housing part (90), the cutter (40) is located between the outlet end (98) and the paste part (10), wherein the cutter includes an edge (45) projecting towards the paste part.

2. A toothpaste according to claim 1, characterized in that the pastes in each layer of paste in the paste part (10) are different from the pastes in every other layer of paste in the housing.

3. A toothpaste according to claim 1, characterized in that an inside wall of the housing part (90) is coated by a biotic small molecule gel lubricant film (97).

4. A compound toothpaste, comprising a paste part (10), a housing part (90) with an outlet end (98) and an outlet cover (20) which removably covers the outlet end, characterized in that the paste part (10) has at least two layers of pastes and a biomacromolecule colloid diaphragm (16) between the layers of the pastes, in which the paste in each layer of the paste is of different ingredients from that in every other layer; the paste part is packed into the housing part (90) in order that the paste in each layer of paste in the paste part (10) is squeezed out of the outlet end (98) in a definite sequence while using the toothpaste; a lubricant film (97) coated on an inside wall of the housing part (90); and a cutter (40), with an edge (45) projecting towards the paste part, located in the housing part (90) near the outlet (98).

5. A method of making a compound toothpaste, characterized in that the method includes the following steps: (a) providing a housing part (90); (b) filling a first layer of paste into the housing part (90); (c) forming a biomacromolecule colloid diaphragm (16) on the first layer of paste; and (d) filling a second layer of paste into the housing part on the biomacromolecule colloid diaphragm, so as to separate the first layer of paste and the second layer of paste with the biomacromolecule colloid diaphragm.

6. A method according to claim 5, further comprising a step of repeating the steps of forming the biomacromolecule colloid diaphragm and filling the paste until the desired number of layers of paste are within the housing part.

7. A method according to claim 5, further comprising the step of forming a lubricant film (97) on an inside wall of the housing part, before the step of filling the housing with paste.

8. A toothpaste according to claim 2, characterized in that an inside wall of the housing part (90) is coated by a biotic small molecule gel lubricant film (97).

9. A method according to claim 6, further comprising the step of forming a lubricant film (97) on an inside wall of the housing part, before the step of filling the housing with paste.

10. A compound toothpaste according to claim 1, wherein the housing part includes a longitudinal axis and each biomacromolecule colloid diaphragm is substantially perpendicular to the longitudinal axis.

11. A compound toothpaste according to claim 1, wherein each biomacromolecule colloid diaphragm is movable within the housing part.

12. A compound toothpaste, comprising:

a housing part having an outlet end and a longitudinal axis;

a paste part located in said housing part, wherein said paste part includes at least two layers of paste wherein the layers of paste are arranged sequentially along the longitudinal axis of said housing part;

a diaphragm located between each two adjacent layers of said paste, wherein said diaphragm is substantially perpendicular to said longitudinal axis.

13. A toothpaste according to claim 12, wherein the paste in each pair of adjacent layers is different.

14. A toothpaste according to claim 12, further comprising a cutter located in said housing part near said outlet end.

15. A toothpaste according to claim 14, wherein said cutter includes a cutting edge projecting towards said paste part.

16. A toothpaste according to claim 12, wherein said diaphragm is made of a biomacromolecule colloid.

17. A toothpaste according to claim 12, further comprising a lubricant film on an inside wall of said housing part.

18. A toothpaste according to claim 17, wherein said lubricant film is a biotic small molecule gel.

19. A toothpaste according to claim 12, wherein said diaphragm is movable along said longitudinal axis.

* * * * *